US006979223B2

(12) United States Patent
Chen

(10) Patent No.: US 6,979,223 B2
(45) Date of Patent: Dec. 27, 2005

(54) INDICATOR CIRCUIT ARRANGEMENT OF A TRANSMISSION CABLE FOR COMPUTER

(76) Inventor: Wilson Chen, 3F, No. 1, Alley 6, Lane 45, Pao-Hsin Rd., Hsin-Tien, Taipei (TW)

( * ) Notice: Subject to any disclaimer, the term of this patent is extended or adjusted under 35 U.S.C. 154(b) by 0 days.

(21) Appl. No.: 10/809,518

(22) Filed: Mar. 26, 2004

(65) Prior Publication Data

US 2005/0215110 A1 Sep. 29, 2005

(51) Int. Cl.[7] ..... H01R 3/00
(52) U.S. Cl. ..... 439/490; 439/502
(58) Field of Search ..... 439/489, 490 I, 439/502

(56) References Cited

U.S. PATENT DOCUMENTS 3,942,859 A * 3/1976 Korodi ..... 439/490
5,644,462 A * 7/1997 Boschetto et al. ..... 361/91.5
5,666,453 A * 9/1997 Dannenmann ..... 385/101
6,361,357 B1 * 3/2002 Stillwell et al. ..... 439/490
6,710,254 B2 * 3/2004 Yueh ..... 174/135

* cited by examiner

*Primary Examiner*—Thanh Tam Le
(74) *Attorney, Agent, or Firm*—Rosenberg, Klein & Lee

(57) ABSTRACT

An indicator circuit arrangement of a transmission cable for connecting a peripheral apparatus to a computer is disclosed to have a cord-like electroluminescent lamp axially extended in the cable between the electric connectors at the ends of the cable, and a detector and converter circuit installed in one electric connector and adapted to detect the connection status of the cable between the computer and the peripheral apparatus and to drive on the cord-like electroluminescent lamp upon normal connection of the cable between the computer and the peripheral apparatus.

1 Claim, 5 Drawing Sheets

INDICATOR CIRCUIT ARRANGEMENT OF A TRANSMISSION CABLE FOR COMPUTER

BACKGROUND OF THE INVENTION

1. Field of the Invention

The present invention relates to a transmission cable for computer and more particularly, to the indicator circuit arrangement of a transmission cable for computer, which uses a detector converter circuit to detect the connection status of the cable and to drive on a cord-like electroluminescent lamp in the cable.

2. Description of the Related Art

FIG. 1 illustrates a transmission cable for computer according to the prior art. According to this design, the transmission cable 10 comprises a cable 12 and two electric connectors 11, 11' at the ends of the cable 12. The transmission cable 10 can be a USB (universal serial bus) design or IEEE1394 parallel bus design. The electric connectors 11, 11' each have a LED (light emitting diode) mounted on the inside. One electric connector 11 or 11' has a detecting circuit (not shown) provided on the inside. The detecting circuit detects connection and signal transmission status of the transmission cable 10, and controls the operation of the LEDs of the electric connectors 11, 11' subject to detection result. This design of transmission cable is functional, however it is still not satisfactory in use. Because the electric connectors 11, 11' are respectively connected to the computer and the peripheral apparatus, the computer and the peripheral apparatus may keep the light of the LEDs of the electric connectors 11, 11' from sight. Further, when several transmission cables are arranged together, the user cannot quickly inspect the connection status of one specific transmission cable from a group of transmission cables.

SUMMARY OF THE INVENTION

The present invention has been accomplished under the circumstances in view. It is one object of the present invention to provide an indicator circuit arrangement of a transmission cable for computer, which gives off light through the length of the cable to indicate normal connection of the cable between the computer and the peripheral apparatus. It is another object of the present invention to provide an indicator circuit arrangement of a transmission cable for computer, which gives off a particular color of light upon normal connection of the cable between the computer and the peripheral apparatus for quick identification. To achieve these and other objects of the present invention, the indicator circuit arrangement is installed in a transmission cable, which comprises a cable, two electric connectors respectively connected to two distal ends of the cable for connecting a peripheral apparatus to a computer for signal transmission, and a plurality of indicator lights respectively installed in the electric connectors. The indicator circuit arrangement comprises a cord-like electroluminescent lamp installed in the cable and axially extended between the two electric connectors, and a detector converter circuit mounted in one electric connector and electrically connected to the cord-like electroluminescent lamp and the indicator lights of the electric connectors and adapted to detect electric connection of the electric connectors between the computer and the peripheral apparatus and to drive on/off the cord-like electroluminescent lamp and the indicator lights subject to the connection status of the electric connectors between the computer and the peripheral apparatus.

DETAILED DESCRIPTION OF THE PREFERRED EMBODIMENT

Figure 1:
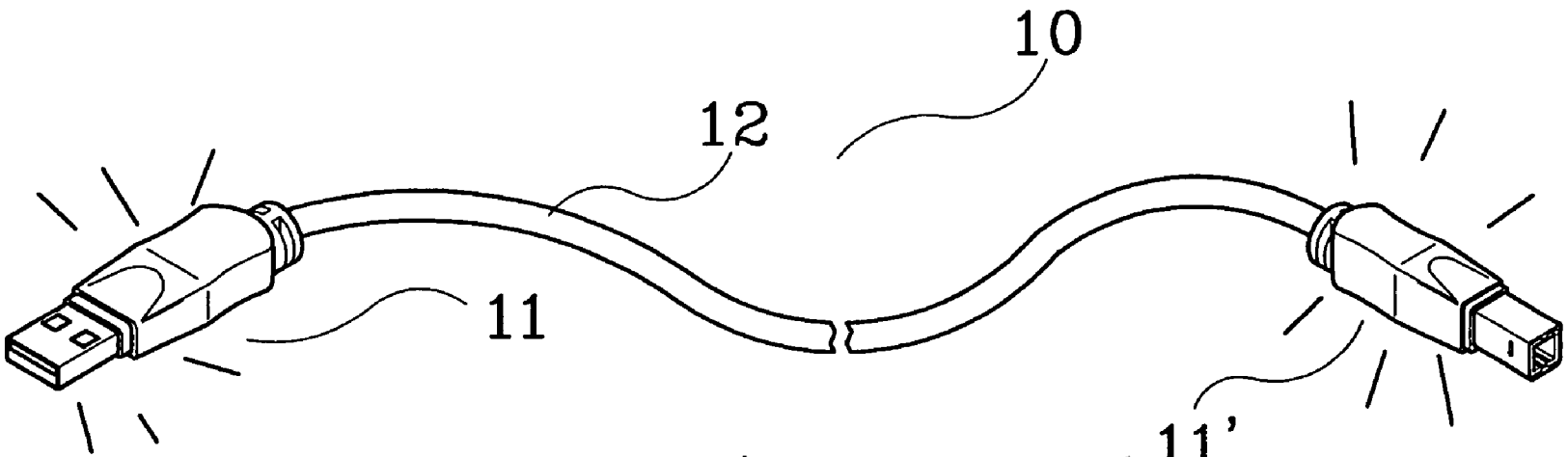
FIG. 1(PRIOR ART)
FIG. 1 is a schematic drawing of a transmission cable for compute according to the prior art.
Figure 2:
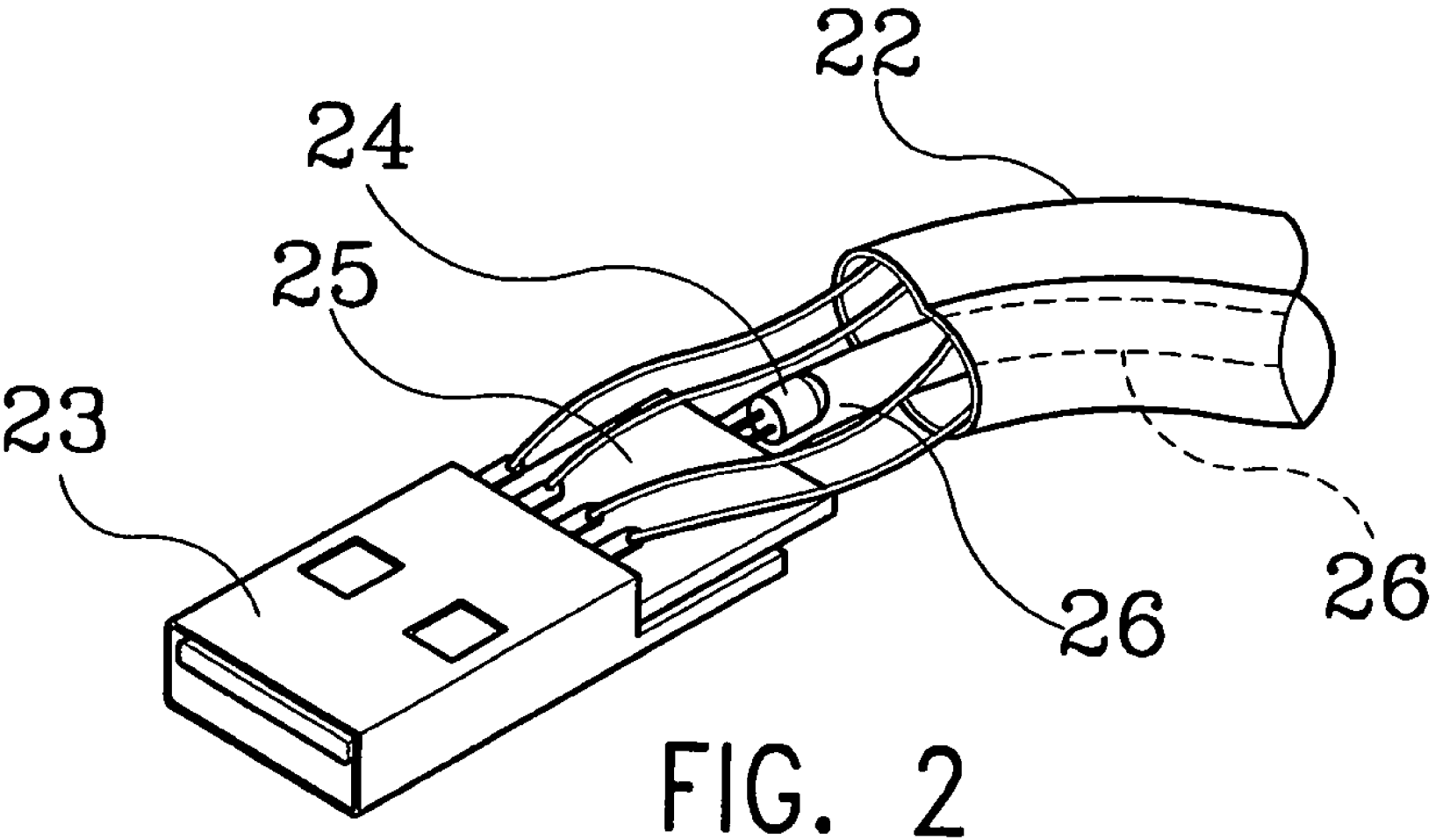
FIG. 2 is a cutaway view showing an indicator circuit arrangement installed in a transmission cable according to the present invention.
Figure 3:
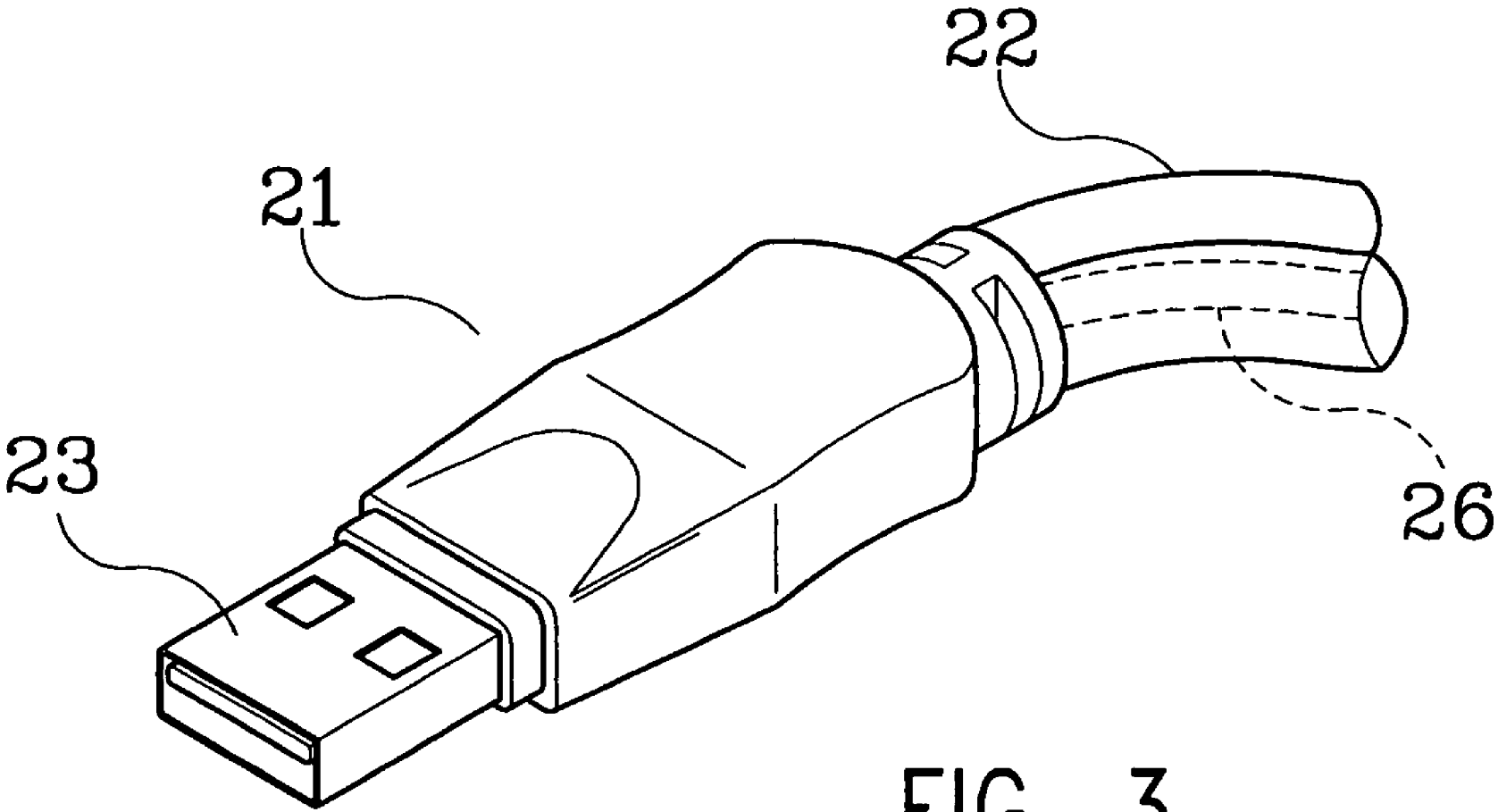
FIG. 3 illustrates the outer appearance of the transmission cable shown in FIG. 2.
Figure 4:
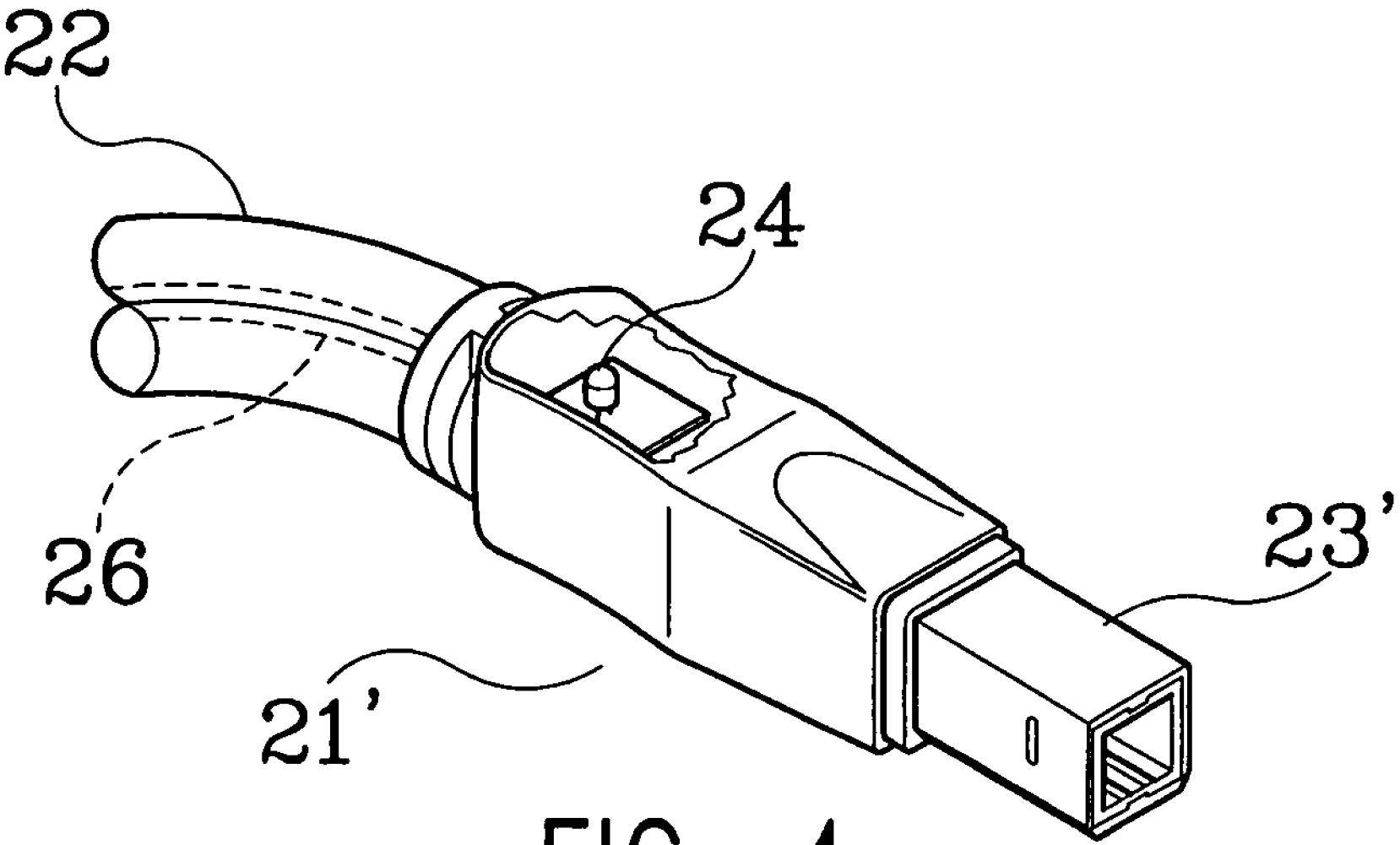
FIG. 4 is a partial view of the transmission cable showing another structure of electric connector at the other end of the cable according to the present invention.
Figure 5:
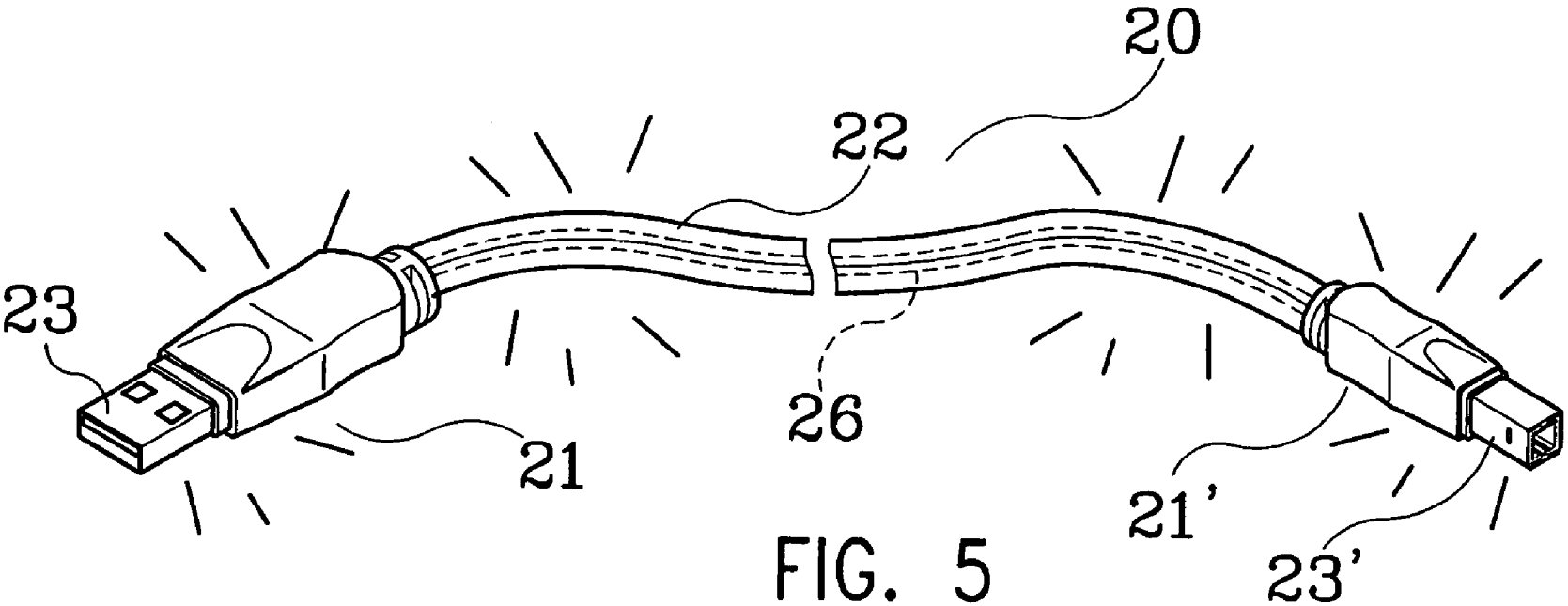
FIG. 5 is a schematic drawing showing a status of use of the transmission cable according to the present invention.

Referring to FIGS. 2~5, a transmission cable 20 is shown for connecting a peripheral apparatus to a computer. The transmission cable 20 can be a universal serial bus or IEEE1394 parallel bus design, comprising a cable 22, two electric connectors 21, 21' respectively connected to the two distal ends of the cable 22, a cord-like electroluminescent lamp 26 axially mounted in the cable 22 and electrically connected between the electric connectors 21, 21'. The cable 22 has an electrically insulative transparent outer shell. The electric connectors 21, 21' each have an indicator light (lighting emitting diode) 24 installed therein. Further, a detector converter circuit 25 is installed in the housing 23 or 23' of one electric connector 21 or 21'.

The detector converter circuit 25 is adapted to detect normal connection of the transmission cable between the computer and the peripheral apparatus and to convert DC to AC, i.e., to convert 5V obtained from the computer into the desired working voltage for driving the cord-like electroluminescent lamp 26.

The detector converter circuit 25 turns on the cord-like electroluminescent lamp 26 and the LEDs 24 in the electric connectors 21, 21' (see FIG. 5) after normal connection of the transmission cable 20 between the computer and the peripheral apparatus, and drives the cord-like electroluminescent lamp 26 and the LEDs 24 to flash upon transmission of a signal between the computer and the peripheral apparatus through the cable 22. On the contrary, disconnection of the transmission cable 20 between the computer and the peripheral apparatus causes the detector converter circuit 25 to turn off the cord-like electroluminescent lamp 26 and the LEDs 24.

Further, the cord-like electroluminescent lamp 26 can be made to produce a particular color of light. By means of the control of the detector converter circuit 25, the cord-like electroluminescent lamp 26 is automatically turned on to emit cold light upon connection of the transmission cable 20 between the computer and the peripheral apparatus, and driven to flash upon transmission of a signal between the computer and the peripheral apparatus through the transmission cable 20.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An indicator circuit arrangement installed in a transmission cable comprising a cable, two electric connectors respectively connected to two distal ends of said cable for connecting a peripheral apparatus to a computer for signal transmission, and a plurality of indicator lights respectively installed in said electric connectors, the indicator circuit arrangement comprising a cord-like electroluminescent lamp installed in said cable and axially extended between said two electric connectors, and a detector converter circuit mounted in one said electric connector and electrically connected to said cord-like electroluminescent lamp and the indicator lights of said electric connector and adapted to detect electric connection of said electric connectors between the computer and the peripheral apparatus and to drive on/off said cord-like electroluminescent lamp and the indicator lights of said electric connector subject to the connection status of said electric connectors between the computer and the peripheral apparatus.

* * * * *